US007425257B2

(12) United States Patent
Osara et al.

(10) Patent No.: US 7,425,257 B2
(45) Date of Patent: Sep. 16, 2008

(54) METHOD FOR THE FORMATION OF A GOOD CONTACT SURFACE ON A CATHODE SUPPORT BAR AND SUPPORT BAR

(75) Inventors: Karri Osara, Noormarkku (FI); Veikko Polvi, Pori (FI)

(73) Assignee: Outotec Oyj, Espoo (FI)

( * ) Notice: Subject to any disclaimer, the term of this patent is extended or adjusted under 35 U.S.C. 154(b) by 358 days.

(21) Appl. No.: 10/533,758

(22) PCT Filed: Nov. 6, 2003

(86) PCT No.: PCT/FI03/00826

§ 371 (c)(1),
(2), (4) Date: May 4, 2005

(87) PCT Pub. No.: WO2004/042118

PCT Pub. Date: May 21, 2004

(65) Prior Publication Data

US 2006/0108230 A1 May 25, 2006

(30) Foreign Application Priority Data

Nov. 7, 2002 (FI) ..... 20021990

(51) Int. Cl.
*C25C 1/16* (2006.01)

(52) U.S. Cl. ..... 205/603; 205/602; 205/369; 205/366; 205/184; 205/191; 204/278.5; 204/279; 204/281; 204/286.1; 204/297.01

(58) Field of Classification Search ..... 205/602, 205/603, 369, 366, 184, 191; 204/278.5, 204/279, 281, 286.1, 297.01
See application file for complete search history.

(56) References Cited

U.S. PATENT DOCUMENTS

| | | | | |
|---|---|---|---|---|
| 2,790,656 | A * | 4/1957 | Cook | 403/270 |
| 4,015,099 | A | 3/1977 | Seniuk et al. | |
| 4,035,280 | A * | 7/1977 | Deane et al. | 204/267 |
| 6,045,669 | A * | 4/2000 | Matsumoto et al. | 204/297.01 |
| 2006/0163079 | A1 * | 7/2006 | Osara et al. | 205/184 |

FOREIGN PATENT DOCUMENTS

| | | |
|---|---|---|
| DE | 3323516 | 8/1984 |
| EP | 0376447 | 7/1990 |
| GB | 2252569 | 8/1992 |

* cited by examiner

*Primary Examiner*—Bruce F. Bell
(74) *Attorney, Agent, or Firm*—Morgan & Finnegan, L.L.P.

(57) ABSTRACT

The disclosure relates to a method of obtaining a good current contact on the support bar of a cathode used in electrolysis. In this method a highly electroconductive layer is formed on the contact piece on the end of the support bar of the cathode, especially at the point that comes into contact with the electrolysis cell busbar. The electroconductive layer forms a metallic bond with the contact piece of the support bar. The disclosure also relates to the cathode support bar, wherein a highly electroconductive layer is formed to the contact piece on the end of said bar, in particular the area that touches the electrolysis cell busbar.

14 Claims, 1 Drawing Sheet

METHOD FOR THE FORMATION OF A GOOD CONTACT SURFACE ON A CATHODE SUPPORT BAR AND SUPPORT BAR

This application claims the benefit of International Application No. PCT/FI2003/000826 filed on Nov. 6, 2003 under 35 U.S.C. §371, entitled, "Method for The Formation Of A Good Contact Surface On A Cathode Support Bar And Support Bar" which claims the benefit of Finnish Patent Application No. 20021990, filed on Nov. 7, 2002.

FIELD OF THE INVENTION

The invention relates to a method of obtaining a good contact surface on the support bar of a cathode used in metal electrolysis. In this method a highly electroconductive coating is formed on the contact piece on the end of the aluminium support bar of the cathode, especially at the point that comes into contact with the electrolysis cell busbar. The electroconductive coating layer forms a metallic bond with the contact piece of the support bar. The invention also relates to the cathode support bar, where a highly electroconductive layer has been formed to the contact piece on the end of said bar, in particular to the contact surface that touches the electrolysis cell busbar.

BACKGROUND OF THE INVENTION

In electrowinning nowadays, particularly in zinc electrowinning, cathode plates made of aluminium are used, which are connected to support bars. The cathode is lowered into the electrolysis cell by the support bars so that one end of the support bars is located on top of the busbar at the edge of the cell and the other end on top of the insulation. To ensure good electrical conductivity, a contact piece made of copper is attached to the end of the aluminium support bar, and the contact piece is set on top of the busbar. The lower edge of the contact piece is either straight or a notch is made there and the support bar is lowered on top of the busbar at the notch. Both side edges of the notch form a contact point, creating a double contact between the support bar and the busbar. When the lower edge of the contact piece is straight, an plane-type contact is formed between the busbar and contact piece. A straight contact piece is used particularly in large cathodes, known as jumbo cathodes.

The copper contact piece can be attached to the aluminium support bar for example by various welding methods. One of these methods is described for instance in U.S. Pat. No. 4,035,280. The patent also mentions that copper contact pieces may be coated with silver before welding. The publication does not, however, give any further description of how the coating of the contact pieces is carried out apart from this one sentence.

The Japanese application 55-89494 describes another method of manufacturing an electrode support bar. The actual support bar is aluminium and to its end is welded a contact piece with an aluminium core and a copper shell. The contact pieces are given their polygonal form by high-pressure extrusion.

In the prior art, the above-mentioned U.S. Pat. No. 4,035,280 proposed that the contact pieces be coated with silver. Clearly, silver improves the electrical conductivity of the copper piece, but coating of the whole contact piece does not suit its purpose and is costly. The combined aluminium and copper extrusion mentioned in the Japanese application does not necessarily achieve a metallurgical joint between the copper and aluminium, so the joint is electrotechnically weak and is damaged as the electrolyte penetrates the interface.

In zinc electrowinning, the rapid wearing of contact pieces in aluminium cathode support bars and in particular their contact surfaces poses a problem. The cause may mainly be the oxidation of copper into its oxide and the corrosion of oxide into copper sulphate under the effect of the electrolyte. Copper sulphate formed on the contact surface further weakens the electrical conductivity of the contact piece.

The method according to the invention relates to the obtaining of a good contact surface on the aluminium cathode bar used in electrolysis, particularly in zinc electrowinning, onto the end of which bar a separate contact piece is attached. The material used for the contact pieces is copper. According to the method now developed, the area on the lower surface of the support bar contact piece, the contact surface, which is to touch the electrolysis cell busbar, is coated with a highly electroconductive metal or metal alloy such as silver or silver alloy. The cathode is formed of a cathode plate and support bar, wherein the cathode plate is immersed in the electrolysis cell and the support bar is supported by its ends on the sides of the electrolysis cell so that the contact piece is located on top of the busbar. When a metallic joint is formed between the support bar contact piece and the coating made on its lower surface, the problems caused by wear or oxidation of the lower surface of the contact piece are avoided. The invention also relates to the cathode support bar used in electrowinning manufactured with this method, where the contact piece at the end of said bar forms a highly electro-conductive layer, in particular in the place, the contact surface, where it comes into contact with the electrolysis cell busbar.

The essential features of the invention appear in the appended claims.

DETAILED DESCRIPTION OF THE INVENTION

Figure 1:
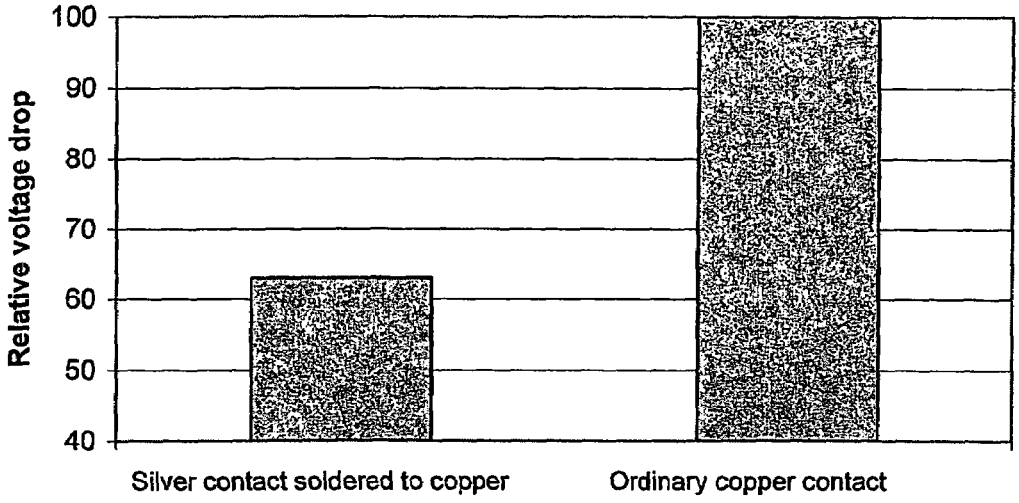
FIG. 1 shows the relative voltage drop of the contact surfaces.

It is important that the contact surface in the cathode support bar contact piece conducts electricity well. The use of a highly electroconductive metal such as silver or silver alloy as coating material ensures an effective feed of current to the cathode. The metallurgical principle for the use of silver is that although it forms oxides on the surface, at relatively low temperatures the oxides are no longer stable and decompose back to metallic form. For the above reasons oxide films do not form on the silver plating made for contact surfaces of contact pieces in the same way as for example on a copper surface.

Silver does not form a metallurgical, very adhesive joint directly on top of copper, so instead a thin transmission layer has to be formed on the copper first, preferably made of tin or tin-dominant alloy. Hereafter in the text for the sake of simplicity we shall refer only to tin, but the term also covers other tin-dominant alloys. Tin layers can be formed in many ways as beforehand by tin plating through heating, electrolytic coating or by thermal spraying directly on the surface point before the actual coating. After this the tin surface can be coated with silver. The coating with silver of the contact surface of the cathode bar contact piece can be carried out for instance with a soldering or thermal spraying technique.

The contact surface of the contact pieces is easy to treat in accordance with the invention even before they are attached to the support bar, but the method is of special benefit in the repair of worn bars. Periodic maintenance of zinc electrowinning cathodes is performed, when the condition of the cathode is checked. The cathode plate wears faster than the support bar and thus the bar outlasts the using time of several cathode plates also in known techiques. The service life of a support bar can however be extended according to this method in a simple way, in that the coating of the contact surface or surfaces of the contact pieces can be renewed as required.

When the contact surface is formed of a notch on the lower surface of the contact piece, the inclined side edges of the notch are straightened out linearly, because the wear of the contact surfaces may have had the result that only one contact point has been formed between the busbar and the support bar. As a result of wear, the support bar begins to bear the load from its bottom section only, so that the geometry of the contact is no longer as desired. Obviously this impairs the feed of current to the cathode. According to the method joint pieces to increase electrical conductivity are attached to the edges of the support bar notch. If a straight lower edge of the contact piece acts as contact surface, it is also advisable to straighten it out before further treatment.

When soldering technique is used, the surface to be treated is cleaned and a layer of tin is formed on it, which is preferably less than 50 μm. Then the silver coating is carried out with some suitable burner. The tin layer melts and when the coating sheet is placed on top of the molten tin, it is easy to position in the correct place.

The contact surfaces of the support bar contact piece can also be coated with silver using thermal spraying technique, since the melting point of silver is 960° C. An AgCu alloy can also be used as coating material e.g. in the form of wire or powder. The melting point of an eutectic AgCu alloy is even lower than that of silver and therefore is suitable for contact surface coating with the technique in question.

Of the thermal spraying techniques available, in practice at least techniques based on gas combustion have proved practicable. Of these, High Velocity Oxy-Fuel (HVOF) spraying is based on the continuous combustion at high pressure of fuel gas or liquid and oxygen occurring in the combustion chamber of the spray gun and the generation of a fast gas flow with the spray gun. The coating material is fed into the gun nozzle most often axially in powder form using a carrier gas. The powder particles heat up in the nozzle and attain a very high kinetic speed (several hundreds of metres per second) and they are directed onto the piece to be coated.

In ordinary flame spraying, as the mixture of fuel gas and oxygen burns it melts the coating material, which is in wire or powder form. Acetylene is generally used as fuel gas due to its extremely hot flame. The coating material wire is fed through the wire nozzle with a feed device using a compressed air turbine or electric motor. The gas flame burning in front of the wire nozzle melts the end of the wire and the melt is blown using compressed air as a metallic mist onto the piece to be coated. The particle speed is in the range of 100 m/s.

Thermal spraying technique melts the surface material and since the molten droplets of the silver-bearing coating have a high temperature, a metallurgical bond is generated between the copper, tin and coating material in the coating of the contact piece notch or lower surface. Thus the electrical conductivity of the joint is good. The metal joining method gives rise to a eutectic of the ternary alloy of silver, tin and copper in the joint area e.g. in a temperature range of 380-600° C. If necessary, separate heat treatment can be carried out after spraying, which promotes the formation of a metallurgical joint.

The method also relates to a cathode support bar used in electrolysis. A very good electroconductive layer is formed on contact pieces situated on the ends of a support bar particularly on an area of the lower surface of the contact pieces, the contact surface, which comes into contact with the electrolysis cell busbar. For a highly electroconductive metal, silver is used, or a silver alloy such as silver copper. The coating of the contact surface is preferably carried out e.g. by soldering or thermal spraying technique, where a metallurgical joint is formed between the contact piece and the coating.

The method of the invention is described further using the appended examples and FIG. 1, which shows the relative voltage drop of the contact surfaces.

EXAMPLE 1

A cathode support bar used in zinc electrowinning was taken for maintenance, where the contact surfaces on the lower surface of the copper contact pieces were found to be worn. Notches acted as the contact surface, and had been in the shape of an upwardly narrowing truncated cone and had been worn to an irregular round shape at the edges. The contact surfaces were cleaned first by sandblasting the dirt off. Then the side surfaces were milled plane type, so that 1-3 mm material was removed from the surfaces. The material removed was replaced by soldering 1-2 mm thick silver pieces of the same size onto the side surfaces.

The soldering was made using a suitable strength oxygen-liquid gas burner and by tin coating a tin layer between the silver and copper surfaces spread by capillary force. When the tin layer was still molten it was simple to position the silver sheet. At the same time the plainness of the tin solder was checked before the temperature was raised by heating the silver surface directly for a few minutes to about 500° C., whereupon the silver and copper were alloyed from pure metals in the soldering area.

A structural study run on the repaired support bar showed that during heating the silver and copper alloyed with the tin layer between them and formed a ternary alloy melting at a much higher temperature than tin. The mechanical and chemical durability of the contact surface made of silver in the way described above has proved excellent.

EXAMPLE 2

A support bar similar to the one in the previous example was used, and the same cleaning and material removal procedures were also performed. A layer of tin was formed on the sides of the notch on the lower surface of the contact piece, with an average thickness of less than 50 μm.

The thermal spraying method used was wire spraying. 3 mm thick silver wire was used in spraying, so that the thickness of the surface produced was 0.5-1.2 mm. Microanalysis study showed that the formation of a metallurgical alloy began as the hot molten drops agglomerated on the tin-coated copper surface.

The structural study showed in addition that the silver had formed a fully compacted metallic structure. The mechanical and chemical durability of the contact surface has proved good in practice.

EXAMPLE 3

Silver pieces have been added to the contact surfaces on the lower surface of the contact parts of a zinc electrowinning cathode support bar. The support bar has been used in production for half a year and so far the wear of the contact surface has been significantly slight i.e. the voltage drop has remained the same the whole time. FIG. 1 shows the difference in relative voltage drop with regard to an old bar, which has ordinary copper contact surfaces. The relative voltage drop of the ordinary copper contact surface has been given the value of 100 and the voltage drop of the contact surface made of silver in accordance with the invention is shown in relation to the conventional contact surface.

The invention claimed is:

1. A method for the formation of a contact surface having good electrical conductivity on a support bar of an aluminum cathode used in electrolysis comprising:

i) attaching a copper contact piece onto the end of the support bar;

ii) forming a transmission layer on an area of the contact surface; and iii) coating the contact surface with a silver or silver alloy having a thickness of 0.5-2 mm by using a soldering or thermal spraying technique, wherein the support bar of an aluminum cathode used in electrolysis is for immersing the cathode plate in an electrolysis cell and supporting the support bar by its ends one the sides of the electrolysis cell so that the contact piece is located on top of a busbar, the lower surface of the contact piece touching the electrolysis cell busbar forming a contact surface, and the transmission layer and the coating form a metallurgical joint with the copper contact piece.

2. The method according to claim 1, wherein the transmission layer is tin or a tin-dominant layer.

3. The method according to claim 1 wherein the thermal spraying technique is based on gas combustion.

4. The method according to claim 1, wherein the thermal spraying technique is high velocity oxy-fuel spraying.

5. The method according to claim 1, wherein silver or silver alloy is in powder form.

6. The method according to claim 1, wherein the thermal spraying technique is flame spraying.

7. The method according to claim 1, wherein silver or silver alloy is in wire form.

8. The method according to claim 1, wherein the contact surface is subjected to heat treatment after coating.

9. A method for repairing a contact surface of an aluminum cathode support bar used in electrolysis, comprising:

i) attaching a copper contact piece to one end of the support bar;

ii) straightening out linearly the contact surface of the support bar contact piece, or lower surface;

iii) forming a transmission layer of tin on the lower surface;

iv) coating the contact surface by using a soldering or thermal spraying technique with silver or silver alloy having a thickness of 0.5-2 mm; and v) forming a metallurgical joint with the copper, tin and silver or silver alloy coating, wherein the support bar of the contact piece is supported on the electrolysis cell busbar and the cathode is immersed into an electrolysis cell.

10. A method for repairing a contact surface of an aluminum cathode support bar used in electrolysis, comprising:

i) attaching a copper contact piece to one end of the support bar;

ii) furnishing the lower edge of the contact piece with a notch;

iii) straightening out linearly the inclined sides of the notch;

iv) forming a transmission layer of tin on the sides;

v) coating the contact surface by using a soldering or thermal spraying technique with silver or silver alloy having a thickness of 0.5-2 mm; and vi) forming a metallurgical joint with the copper, tin and silver or silver alloy coating, wherein the support bar of the contact piece is supported on the electrolysis cell busbar and the cathode is immersed into an electrolysis cell.

11. A support bar for an aluminum cathode used in electrolysis, where a cathode plate of the cathode is meant to be immersed in an electrolysis cell and the cathode support bar is to be supported at its ends on the edge of the electrolysis cell, so that a contact piece of copper is attached to one end of the support bar, wherein the area of the lower surface of the support bar contact piece, the contact surface touching the busbar, comprising a silver or silver alloy coating having a thickness of 0.5-2 mm and before coating, the contact surface comprises a transmission layer, wherein the silver or silver alloy coating forms a metallurgical joint with the transmission layer and the copper of the contact piece.

12. The support bar according to claim 11, wherein the transmission layer is tin or a tin-dominant alloy.

13. The support bar according to claim 11 wherein the silver or silver alloy layer is formed using soldering technique.

14. The support bar according to claim 11 wherein the silver or silver alloy layer is formed using thermal spraying technique.

* * * * *